US011680448B2

(12) United States Patent
Amoudi et al.

(10) Patent No.: US 11,680,448 B2
(45) Date of Patent: Jun. 20, 2023

(54) REDUCING FRICTION IN A DRILL STRING AND CLEANING A WELLBORE

(71) Applicant: Saudi Arabian Oil Company, Dhahran (SA)

(72) Inventors: Ahmad A. Amoudi, Dhahran (SA); Ossama R. Sehsah, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 330 days.

(21) Appl. No.: 17/029,594

(22) Filed: Sep. 23, 2020

(65) Prior Publication Data

US 2022/0090450 A1 Mar. 24, 2022

(51) Int. Cl.

| | |
|---|---|
| ***E21B 7/28*** | (2006.01) |
| ***E21B 4/02*** | (2006.01) |
| ***E21B 10/26*** | (2006.01) |
| ***E21B 21/08*** | (2006.01) |
| ***E21B 23/00*** | (2006.01) |
| ***E21B 34/10*** | (2006.01) |

(52) U.S. Cl.

CPC ..... *E21B 7/28* (2013.01); *E21B 4/02* (2013.01); *E21B 10/26* (2013.01); *E21B 21/08* (2013.01); *E21B 23/004* (2013.01); *E21B 34/10* (2013.01)

(58) Field of Classification Search

CPC ..... E21B 17/1057; E21B 17/01064; E21B 17/22; E21B 17/16; E21B 7/28

See application file for complete search history.

(56) References Cited

U.S. PATENT DOCUMENTS

| | | | |
|---|---|---|---|
| 4,298,077 | A | 11/1981 | Emery |
| 4,890,682 | A | 1/1990 | Worrall et al. |
| 10,302,083 | B2 | 5/2019 | Downton |
| 2012/0048619 | A1 | 3/2012 | Seutter et al. |
| 2012/0127829 | A1 | 5/2012 | Sitka |
| 2014/0231144 | A1 | 8/2014 | Sonar et al. |

(Continued)

FOREIGN PATENT DOCUMENTS

| | | |
|---|---|---|
| CA | 2985258 | 5/2018 |

OTHER PUBLICATIONS

PCT International Search Report and Written Opinion in International Appln. No. PCT/US2021/051230, dated Dec. 3, 2021, 15 pages.

*Primary Examiner* — Cathleen R Hutchins

(74) *Attorney, Agent, or Firm* — Fish & Richardson P.C.

(57) ABSTRACT

A drilling assembly includes a drill string configured to be disposed within a wellbore. The drilling assembly also includes a sub fluidically coupled to the drill string. The sub includes a mandrel fixed to the drill string and defines an external helically undulated surface and a bore configured to flow drilling fluid received from the drill string. The sub includes a sleeve rotationally coupled to and disposed outside the mandrel. The sleeve has an internal helically undulated surface corresponding with the external helically undulated surface of the mandrel to form, with the mandrel, a progressive cavity. The progressive cavity receives fluid from the bore of the mandrel to rotate the sleeve as the drilling fluid flows along the cavity. The sub also includes a valve configured to regulate a flow of the drilling fluid along the bore to direct fluid toward or away from the progressive cavity.

20 Claims, 6 Drawing Sheets

(56) References Cited

U.S. PATENT DOCUMENTS

| | | | | |
|---|---|---|---|---|
| 2015/0144359 | A1* | 5/2015 | Schultz | E21B 7/20 166/382 |
| 2015/0354281 | A1 | 12/2015 | Schultz et al. | |
| 2016/0290117 | A1* | 10/2016 | Dykstra | E21B 44/06 |

* cited by examiner

REDUCING FRICTION IN A DRILL STRING AND CLEANING A WELLBORE

FIELD OF THE DISCLOSURE

This disclosure relates to wellbores, in particular, to drill strings and equipment for drilling wellbores.

BACKGROUND OF THE DISCLOSURE

A drill string is a tubing assembly used to drill a wellbore. A wellbore is a hole in a geologic formation that allows the extraction of natural resources from the formation, such as water and hydrocarbons. Wellbores can be vertical and non-vertical. During drilling operations, a drill string can be subject to torque and drag, which can limit the performance of the drill string. Torque and drag can be particularly problematic in non-vertical wellbores. Methods and equipment for improving the performance of drill strings are sought.

SUMMARY

Implementations of the present disclosure include a drilling assembly that includes a drill string configured to be disposed within a wellbore. The drill string flows drilling fluid from a surface of the wellbore. The drilling assembly also includes a sub fluidically coupled to the drill string. The sub includes a mandrel fixed to the drill string and defines an external helically undulated surface and a bore configured to flow the drilling fluid received from the drill string. The sub also includes a sleeve rotationally coupled to and disposed outside the mandrel. The sleeve has an internal helically undulated surface corresponding with the external helically undulated surface of the mandrel to form, with the mandrel, a progressive cavity. The progressive cavity is configured to receive fluid from the bore of the mandrel to rotate the sleeve as the drilling fluid flows along the cavity. The sub also includes a valve coupled to the bore of the mandrel. The valve is configured to regulate a flow of the drilling fluid along the bore to direct fluid toward or away from the progressive cavity.

In some implementations, the bore of the mandrel includes two fluid ports spaced from each other. The sleeve includes a fluid inlet communicatively coupled to and configured to receive the drilling fluid from one of the two fluid ports. The sleeve also includes a fluid outlet communicatively coupled to and configured to flow the drilling fluid to the other of the two fluid ports. In some implementations, the sub further includes a cam assembly resigning inside the bore and operationally coupled to the valve. The cam assembly converts a linear force into rotational motion to move the valve to regulate the flow.

In some implementations, the valve includes a choke valve including a needle and a seat. The valve resides between the two fluid ports. The needle defines a tapered end converging in a flow direction of the drilling fluid and the seat is configured to receive the tapered end of the needle to close a fluid pathway of the sub extending along the bore.

In some implementations, the cam assembly includes a rotatable cam shaft residing upstream of the needle. The cam shaft includes a curved end and a pin extending from an exterior surface of the cam shaft. The cam assembly includes a spring configured to urge the cam shaft away from the needle. The cam shaft is configured to move toward the needle under fluidic pressure of the drilling fluid. The cam assembly includes a continuous zigzag-shaped groove configured to receive the pin and extending along a circumference of the bore or a cam sleeve of the cam assembly attached to the bore. The pin is configured to follow the groove to rotate the cam shaft as the spring or fluidic pressure moves the cam shaft in a direction parallel to the flow direction of the fluid. The needle is rotationally fixed with respect to the cam shaft and including a curved end opposite the tapered end and facing the curved end of the shaft. The curved end of the needle corresponds with the curved end of the cam shaft such that rotation of the cam shaft at least intermittently moves the needle in a direction parallel to the flow direction of the fluid toward the seat of the valve.

In some implementations, the cam shaft is configured to move toward the needle with the drilling fluid at a first flow rate, and the spring is configured to move the cam shaft away from the needle with the drilling fluid at a second flow rate less than the first flow rate.

In some implementations, the drilling assembly further includes a processor communicatively coupled to one or more sensors coupled to the drill string. The sensors are configured to detect and transmit, to the processor, a pressure of the drilling fluid in the drill string. The processor is configured to determine, based on the detected pressure, a flow rate of the drilling fluid required to move the cam shaft along the fluid direction of the drilling fluid to at least one of: begin rotation of the sleeve, increase a revolutions per minute of the sleeve, or stop the sleeve from rotating.

In some implementations, the choke valve includes a spring configured to urge the needle away from the seat, the spring is configured to at least intermittently move the needle away from the seat as the cam shaft rotates along the groove.

In some implementations, the sleeve or the mandrel includes a locking assembly disposed between the sleeve and the mandrel. The locking assembly is configured to constrain the sleeve to rotation along the rotational direction of the drill string. The sleeve is configured to rotate at higher revolutions per minute than the drill string.

In some implementations, the sleeve includes a reaming outer surface that includes external blades or grooves configured to ream and clean the wellbore during rotation of the sleeve.

In some implementations, the blades or groves span at least 70% of a length of the sleeve.

In some implementations, the blades or grooves include router flutes arranged to agitate, during rotation of the sleeve, drilling cuttings in the wellbore to allow the drilling cuttings to flow, with the drilling fluid, to a surface of the wellbore.

Implementations of the present disclosure include an apparatus that includes a stator, a rotor, and a flow regulation assembly. The stator is fluidically coupled to and rotationally fixed to a pipe. The stator includes a bore configured to receive and flow fluid from the pipe. The stator includes a helically undulated outer surface and two fluid ports configured to fluidically couple the helically undulated outer surface with the bore. The rotor is rotationally coupled to the stator. The rotor resides outside the stator. The rotor includes a helically undulated internal surface to form, with the helically undulated outer surface of the stator, a progressive cavity. The progressive cavity extends from one of the two fluid ports to the other of the two fluid ports. The progressive cavity is configured to receive fluid from the bore of the stator to allow the fluid to rotate the rotor as the fluid flows along the progressive cavity. The flow regulation assembly is coupled to the bore between the two ports. The flow regulation assembly is configured to divert an amount of fluid flowing toward the progressive cavity by decreasing an amount of fluid flowing past the flow regulation assembly.

In some implementations, the pipe includes a drill pipe configured to be disposed within a wellbore. The rotor includes an outer surface that defines external blades or grooves configured to contact a wall of the wellbore to agitate the drill string during rotation of the rotor. The outer surface is configured to loosen, during rotation of the rotor, cuttings in the wellbore to allow the drilling cuttings to flow, with the fluid, to a surface of the wellbore.

In some implementations, the flow regulation assembly includes a cam assembly and a choke valve coupled to the cam assembly. The choke valve includes a needle and a seat. The cam assembly includes a spring and a cam shaft configured to rotate under a fluidic pressure of the fluid applied at a first end of the cam assembly. The cam shaft is configured to rotate under a normal force applied by the spring to a second end of the cam assembly opposite the first end. The cam shaft defines a curved end facing the needle. The cam shaft is configured to convert rotational motion into linear motion to intermittently move, during rotation of the cam shaft, the needle toward the seat by contactingly pushing the needle during rotation of the cam shaft.

In some implementations, the apparatus further includes a processor communicatively coupled to one or more sensors coupled to the drill string. The sensors are configured to detect and transmit, to the processor, a pressure of the drilling fluid in the drill string. The processor is configured to determine, based on the detected pressure, a flow rate of the drilling fluid required to move the cam shaft along the fluid direction of the drilling fluid to at least one of: begin rotation of the sleeve, increase a revolutions per minute of the sleeve, or stop the sleeve from rotating.

Implementations of the present disclosure include a method that includes receiving, by a processor and from a sensor, fluid information including a pressure of a drilling fluid flowing along a bore of a drilling sub. The drilling sub includes a stator fluidically coupled to and rotationally fixed to a drill string. The stator includes the bore configured to receive and flow the drilling fluid from the drill string. The stator includes a helically undulated outer surface. The rotor is rotationally coupled to and resides outside the stator. The rotor includes a helically undulated internal surface to form, with the helically undulated outer surface of the stator, a progressive cavity configured to receive the drilling fluid from the bore of the stator to allow the drilling fluid to rotate the rotor as the fluid flows along the progressive cavity. The drilling sub also includes a valve coupled to the bore, and a cam assembly coupled to and configured to move the valve to regulate a flow of drilling fluid along the bore. The method also includes determining, by the processor and based on the fluid information, a flow rate of the drilling fluid required to actuate the cam assembly to regulate a flow of fluid along the bore to change a rotational speed of the rotor. The method also includes transmitting, to a receiver, the flow rate to be used by a controller or an operator to change a flow rate of the drilling fluid.

In some implementations, the sensor is coupled to the drill string at a surface of the wellbore and configured to detect a fluidic pressure of the drilling fluid, and determining the flow rate includes determining a flow rate required to move the cam assembly to 1) decrease an amount of fluid flowing past the valve to increase a rotational speed of the rotor or 2) increase an amount of fluid flowing past the valve to decrease a rotational speed of the rotor.

In some implementations, the method further includes determining, based on drilling information received from the drill string, the flow rate. The information includes at least one of an angle of the wellbore, drag of the drill string, or torque of the drill string.

In some implementations, the cam assembly includes a spring configured to urge a portion of the cam assembly in a direction opposite the flow direction of the fluid with the drilling fluid below a predetermined flow rate. Determining the flow rate includes determining a flow rate above the predetermined flow rate to move the portion of the cam assembly toward the valve to rotate the portion of the cam assembly. Determining the flow rate also includes determining a flow rate below the predetermined flow rate to allow the spring to move the portion of the cam assembly away from the valve to rotate the portion of the cam assembly.

DETAILED DESCRIPTION OF THE DISCLOSURE

The present disclosure describes a drilling sub that is attached to a drill string during drilling of a wellbore. The drilling sub rotates to agitate the drill string to reduce the torque and drag of the drill string. Additionally, the drilling sub can help clean the wellbore by moving the drill cuttings and allowing the drilling fluid in the annulus to flow the drill cuttings to the surface of the wellbore. The drilling sub includes an external rotor and an internal stator that together form a progressive cavity that flows fluid to rotate the rotor, similar to a positive cavity displacement pump or motor. The drilling sub has a valve that diverts all or part of the drilling fluid to the progressive cavity to rotate the rotor. The rotation of the rotor can help clean the wellbore and reduce the undesirable torque and drag of the drill string that is caused by the friction between the drill string and wellbore that results from pressure differentials, wellbore junk, or other conditions.

Particular implementations of the subject matter described in this specification can be implemented so as to realize one or more of the following advantages. For example, reducing the torque and drag experienced by the drill string can increase the delivered amount of torque to the drilling bit from the top drive, improving the performance of the drill bit. Additionally, poor hole cleaning could result in many drilling problems, such as back off stuck pipe, high torque and drag, and increasing mud weight and rheology. Effective wellbore cleaning may be difficult in horizontal wells because the cuttings can accumulate below the drill string. The drilling sub of the present disclosure can agitate or move the cuttings to allow the drilling fluid to move the cuttings to the top of the wellbore, cleaning the wellbore without changing the mud rheology and thus reducing costs.

Figure 1:
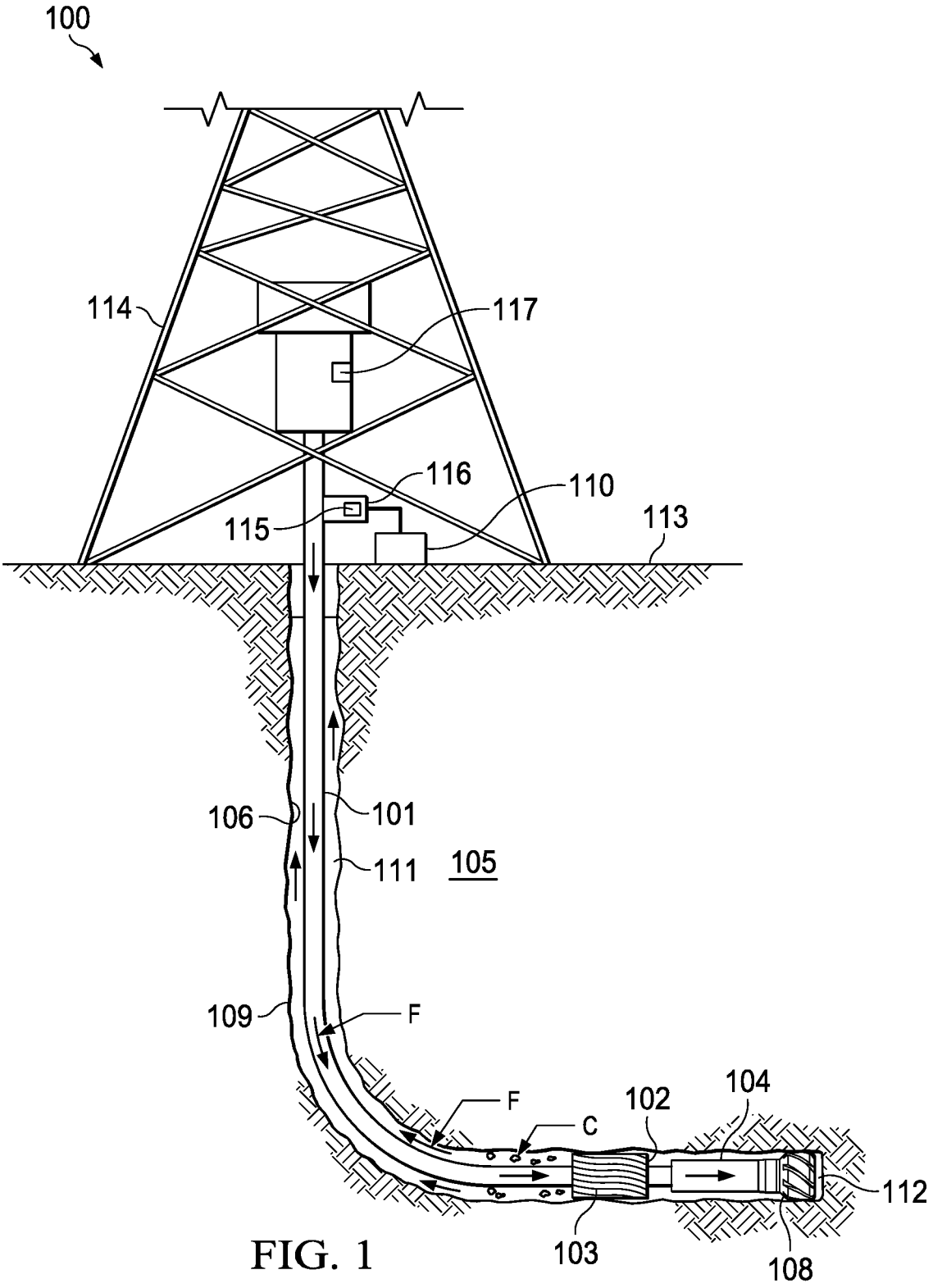
FIG. 1 is a front schematic view, partially cross sectional, of a wellbore assembly according to implementations of the present disclosure.

FIG. 1 shows a drilling assembly 100 that includes a drill string 101 and a sub 102 (e.g., a drilling sub) coupled to the drill string 101. The drill string 101 is disposed within a wellbore 106 (e.g., a lateral or non-vertical wellbore) formed in a geologic formation 105 that may include a hydrocarbon reservoir from which hydrocarbons can be extracted. The drill string 101 extends from a surface 113 of the wellbore 106 to a downhole end 112 of the wellbore 106. For example, the drill string 101 can extend from a drill rig 114 that resides at the surface 113 of the wellbore 106. The drill string 101 includes a drill bit 108 coupled to a downhole end of the drill string 101 and a bottom hole assembly (BHA) 104 coupled to the drill string 101 uphole of the drill bit 108. The drilling sub 102 can be coupled to the drill string 101 uphole of the BHA 104.

The drill string 101 flows, during drilling, drilling fluid 'F' (e.g., drilling mud) from the surface 113 of the wellbore 106 to the downhole end 112 of the wellbore 106. The drilling fluid 'F' leaves the drill string 101 through the drill bit 108 and flows uphole through an annulus 111 formed between the drill string 101 and a wall 109 of the wellbore 106. The drilling fluid 'F' flows along the annulus 111 from the drill bit 108 to or near the surface 113 of the wellbore 106 to a mud pump.

During drilling, the drilling sub 102 rotates to agitate or move the drill string 101 with respect to the wellbore 106 to reduce the drag and torque experienced by the drill string 101. In addition, the drilling sub 102 has external blades or grooves 103 that move or agitate the drilling cuttings 'C' in the wellbore 106 to allow the drilling fluid 'F' to flow the cuttings 'C' to the surface of the wellbore 106.

A processing device 110 (e.g., a computing device or a mobile computing device) communicatively coupled to sensors 117 at the rig (e.g., sensors attached to the drill string at the surface 113 of the wellbore 106) can determine the appropriate flow rate of the drilling fluid 'F' required to control the drilling sub 102. For example, the processing device 110 can receive torque and drag information (e.g., information received from the drill string that includes the torque, string load, and drag experienced by the drill string) from the rig sensors 117 and fluid information (e.g., fluidic pressure and flow rate of the drilling fluid) from the rig sensors 117. As further described in detail below with respect to FIG. 5, the processing device 110 can use such information to determine a desired rotational velocity of the drilling sub 102 to clean the wellbore 106 or reduce torque and drag of the drill string 101.

The processing device 110 can be communicatively coupled to a receiver 115 (e.g., a receiver of a controller 116 configured to control the flow rate of the drilling fluid 'F') that receives information from the processor to control the flow rate of the drilling fluid 'F'. The controller 116 can be coupled to a mud pump to control the flow rate of the drilling fluid 'F' flowing downhole to the drill bit. The receiver 115, the controller 116, and the processor 110 can be part of one device (e.g., a computer) or part of separate devices. In some implementations, the processing device 110 can be attached to the drill string 101 or be part of the drilling sub 102. In some implementations, an operator can manually change the flow rate of fluid 'F' based on the information determined by the processor 110.

Figure 2:
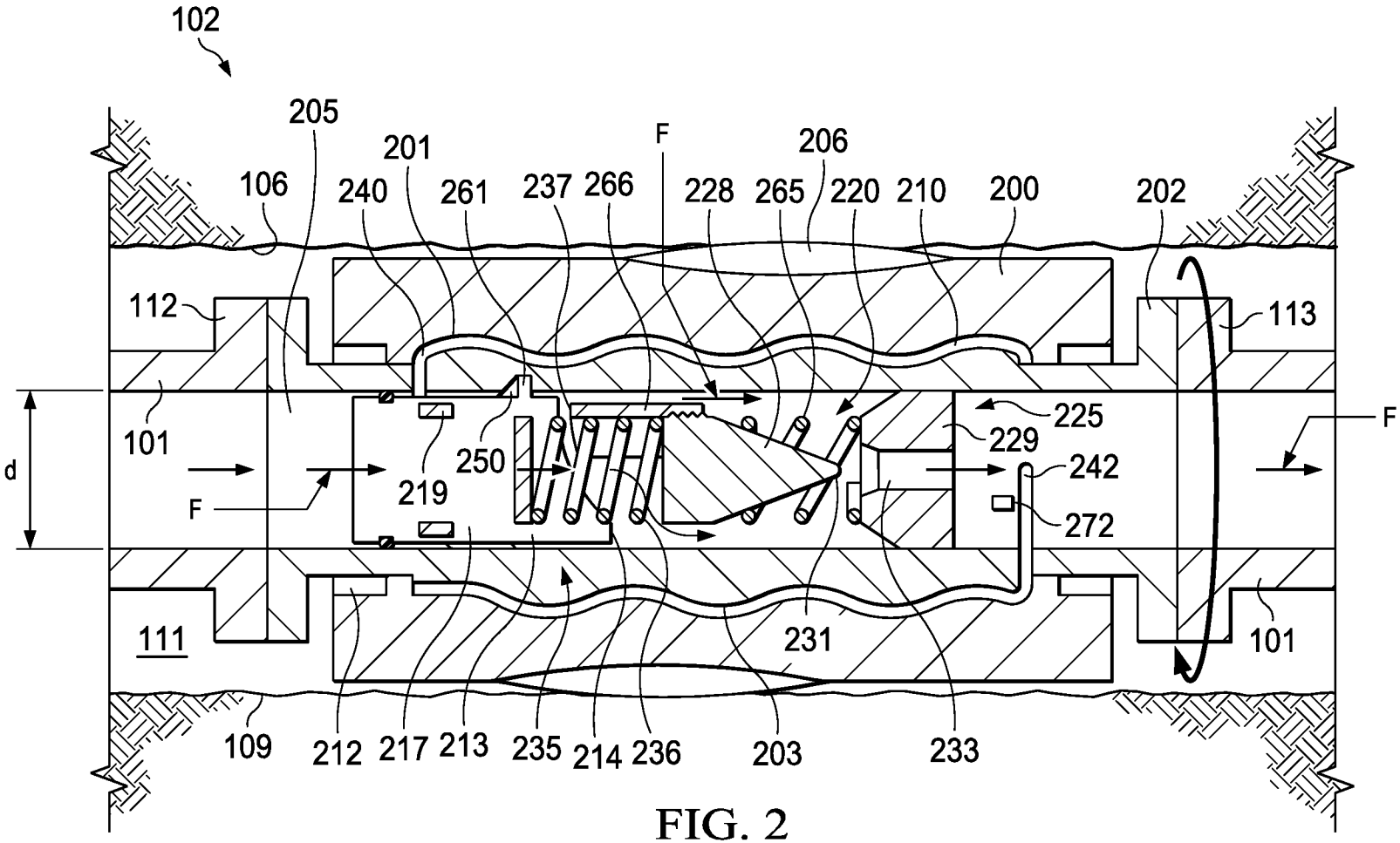
FIG. 2 is a front schematic view, cross sectional, of a drilling sub of the wellbore assembly in FIG. 1, with a valve open.
Figure 3:
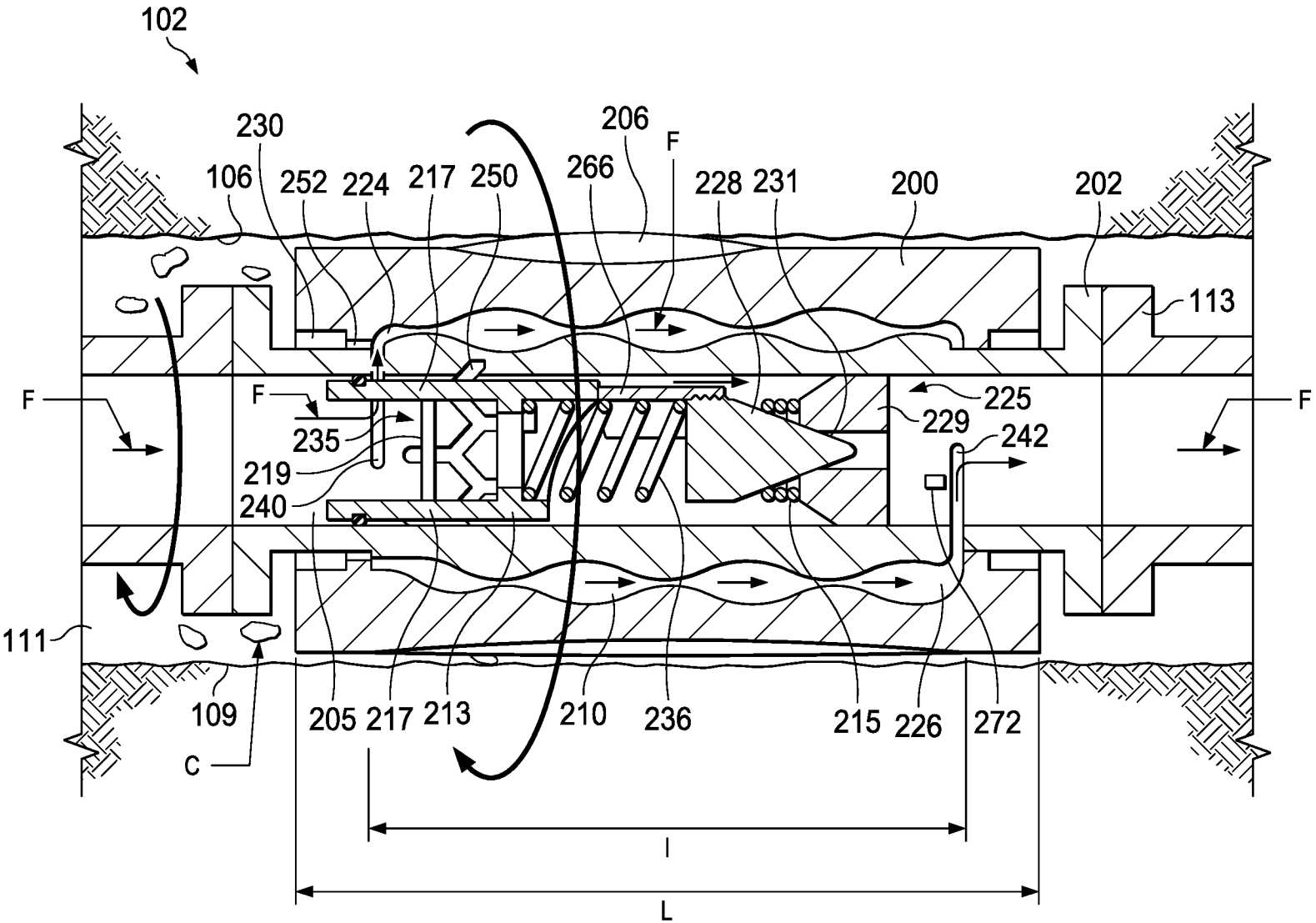
FIG. 3 is a front schematic view, cross sectional, of the drilling sub in FIG. 2, with the valve closed.

FIGS. 2 and 3 show a cross section of the drilling sub 102 fluidically coupled to the drill string 101. As shown in FIG. 2, the drilling sub 102 includes a mandrel 202 (e.g., a stator) fixed (e.g., rotationally fixed) to the drill string 101. The mandrel 202 defines an external helically undulated surface 203 (e.g., an external surface formed by helical lobes) and a bore 205 with a diameter 'd' similar to the internal diameter of drill string 101. The bore 205 flows the drilling fluid 'F' received from an outlet 112 of the drill string 101 to an inlet 113 of a portion of the drill string 101.

The drilling sub 102 also includes a sleeve 200 (e.g., a rotor) rotationally coupled to and disposed outside the stator 202. The rotor 200 has an internal helically undulated surface 201 (e.g., an internal surface formed by helical lobes) that corresponds with the external helically undulated surface 203 of the stator 202 to form, with the stator 202, a progressive cavity 210 that receives drilling fluid 'F' from the bore 205 to rotate the rotor 200 as the drilling fluid 'F' flows along the progressive cavity 210.

Referring also to FIG. 3, the stator 202 has a first fluid port 240 and a second fluid port 242 spaced from the first fluid port 240. The rotor 200 has a fluid inlet 224 (e.g., a groove) communicatively coupled to the first fluid port 240 and a fluid outlet 226 communicatively coupled to the second fluid port 242. The progressive cavity 210 receives drilling fluid 'F' from the first fluid port 240 and flows the fluid 'F' to the second fluid port 242. Thus, the progressive cavity 210 is defined between the fluid inlet 224 and the fluid outlet 226 of the rotor 200. The flow of drilling fluid 'F' along the progressive cavity 210 causes the rotor 200 to rotate with respect to the stator 202. The higher the flow rate, the fastest the rotor 200 rotates.

As shown in FIG. 2, the drilling sub 102 also includes a flow regulation assembly 220 disposed inside the stator 202 and attached to the bore 205. The flow regulation assembly 220 resides between the two ports 240 and 242 of the stator 202. The flow regulation assembly 220 can divert a portion or all of the fluid 'F' from the bore 205 to the progressive cavity 210 to rotate the rotor 200 and to change the rotational speed of the rotor 200. In other words, as shown in FIG. 3, the flow regulation assembly 220 can increase an amount of fluid 'F' flowing toward the progressive cavity 210 by decreasing an amount of fluid 'F' flowing past the flow regulation assembly 220. As shown in FIG. 2, the flow regulation assembly 220 can, when open, allow the drilling fluid 'F' to flow past the flow regulation assembly 200 substantially uninterruptedly to allow the drilling fluid 'F' to flow to the drill bit.

The flow regulation assembly 220 includes a valve 225 and a cam assembly 235 coupled (e.g., operationally coupled) to the valve 225. The valve 225 can be a choke valve that includes a needle 228 and a seat 229. The needle 228 defines a tapered end 231 converging in a flow direction of the drilling fluid 'F'. The seat 229 is attached (e.g., threadedly attached) to the bore 205 and has an aperture 233 that receives the tapered end 231 of the needle 233 to close a fluid pathway of the sub 102 extending along the bore 205. The cam 235 moves the needle 228 toward the seat 229 to regulate a flow of the drilling fluid 'F' along the bore 205 to direct fluid 'F' toward or away from the progressive cavity 210.

The cam assembly 235 converts a linear force (e.g., fluidic pressure from the outlet 112 of the drill pipe 101) into rotational motion to push the needle 228 toward the seat 229 to regulate the flow and create back pressure on top of the needle-seat valve (e.g., choke valve) to divert the flow of fluid 'F' toward the fluid port 240. Specifically, as shown in FIG. 3, the cam assembly 235 includes a rotatable cam shaft 213 (e.g., a tube made of two symmetric bodies 217 separated by two arms 219) residing upstream of the needle 228.

The rotatable cam shaft 213 has a curved end 214 facing a curved end 237 of the needle 228 (e.g., a curved end of a needle sleeve 266 attached to the needle 228) that is opposite the tapered end 231 of the needle 228. The cam shaft 213 also includes a pin 261 that extends from an exterior surface of the cam shaft 213 in a direction perpendicular to the flow direction of the fluid 'F'. The cam assembly 235 also includes a spring 236 disposed between an inner shoulder of the cam shaft 213 and the needle 228 to urge or push the cam shaft 213 away from the needle 228. The cam shaft 213 in the position illustrated in FIG. 2 can block the fluid 'F' from entering the fluid port 240 and then open a fluid pathway as the cam shaft 213 rotates to expose the fluid port 240 to the bore 205.

The cam shaft 213 moves toward the needle under fluidic pressure of the drilling fluid 'F'. The cam assembly 235 also includes a continuous or annular zigzag-shaped groove 250 formed in the bore 205 (e.g., extending along a circumference of the bore 250) or in a sleeve coupled to the bore. The groove 250 receives the pin 261 of the cam shaft 213 and the pin 261 follows the groove 250 to rotate the cam shaft 213 as the spring 236 or as fluidic pressure of the fluid 'F' moves the cam shaft 213 in a direction parallel to the flow direction of the fluid 'F'. The needle 228 is rotationally fixed with respect to the cam shaft 213 and the curved end 237 of the needle sleeve 266 corresponds with the curved end 214 of the cam shaft 213 such that rotation of the cam shaft 213 at least intermittently moves the needle 228 in a direction parallel to the flow direction of the fluid toward the seat 229 of the valve 225.

More specifically, the cam shaft 213 is coupled to the bore 205 and is movable along the direction of the groove (e.g., along the flow direction of the fluid 'F' as the pin 261 follows the groove extending at an angle with respect to the flow direction of the fluid 'F') and rotatable along the groove with respect to the stator 202. The cam shaft 213 moves toward the needle 228 when the drilling fluid 'F' flows at a first flow rate, and the spring 236 moves the cam shaft 213 away from the needle when the drilling fluid 'F' flows at a second flow rate that is less than the first flow rate. In other words, the spring 236 has a stiffness that allows the spring 236 to compress under a certain flow rate (and fluidic pressure) of the fluid 'F'. The movement of the cam shaft 214 can be described in two repeating stages. For example, in the 'first stage', the increase in flow rate creates a temporary differential pressure across the cam shaft 213. This differential pressure may multiply by cross sectional area of the shaft since it has smaller internal diameter to overcome the stiffness of the sprig 236 and moving the cam shaft toward the needle 228. Once the pressure stabilizes across the shaft 213, the spring 236 begins to push the shaft away from the needle 228, allowing the 'second stage' to begin. When the fluid 'F' is above a certain flow rate (e.g., 200 GPM), the fluid 'F' pushes the cam shaft 213 to compress the spring 236 and when the fluid 'F' is below a certain flow rate (e.g., 50 GPM), the spring 236 extends to move the cam shaft 236 away from the needle 228. As further described in detail below with respect to FIG. 4, as the cam shaft 213 is moved by the spring and fluid 'F', the cam shaft 213 rotates as the pin 261 follows the groove 250. The rotation of the cam shaft 213 exposes the fluid port 240 to receive the fluid 'F'.

As shown in FIG. 3, the rotation of the cam shaft 213 allows the longer portion of the cam shaft 213 to meet the longest portion of the needle sleeve 266 to begin moving (e.g., by pushing) the needle toward the seat 229. A second spring 265 is disposed between the seat 229 and the needle 228 and can have a stiffness greater than the spring 236 of the cam assembly 235 so that compressing the spring 236 of the cam assembly 235 does not compress or significantly compress the second spring 265. The second spring 265 urges the needle 228 away from the seat in a direction opposite to the flow direction of the fluid 'F'. The second spring 265 is under a preload when the cam shaft 213 moves the needle 228 toward the seat 229 so that, when the cam shaft 213 rotates to misalign the longest portion of the cam shaft 213 with the longest portion of the needle sleeve 233, the second spring 265 moves the needle 228 away from the seat 229. Thus, the spring 265 at least intermittently moves the needle 228 away from the seat 229 as the cam shaft 213 rotates along the groove 250.

As shown in FIG. 3, the rotor 200 or the stator 202 has a locking assembly 252 (e.g., spring loaded ratchet and pawl mechanism) disposed between the rotor 200 and the stator 202 to constrain the rotor 200 to rotation along the rotational direction of the drill string 101. For example, the locking assembly 252 rotationally locks the rotor 202 from rotating opposite to the rotation of the drill string 101. The rotor 200 can rotates at higher revolutions per minute than the drill string 101.

The rotor 200 rotates with respect to the stator 202 to reduce the friction between the drill string 101 and the wellbore 106. Specifically, the rotor 200 can have an outer diameter larger than an outer diameter of the drill string 101 to contact the wall 109 of the wellbore 106 and relieve the drill string 101 from torque and drag otherwise experienced by the drill string 101. Additionally, the rotation of the rotor 200 can create oscillation of the drill string 101 to reduce the torque and drag.

The rotor 200 has an outer surface (e.g., a reaming outer surface) that includes external blades 206 or grooves that can ream and clean the wellbore 206 or move drilling cuttings 'C' during rotation of the rotor 200. The blades 206 may span at least 70% of a length 'L' of the rotor. For example, the rotor can have a length 'L' of about 10 feet and the blades 206 can have a length of about 0.1 feet that together spanning a length 'l' of about 7 feet or longer. The blades 206 or grooves can be or include router flutes arranged to agitate or loosen, during rotation of the rotor 200, the drilling cuttings 'C' in the wellbore 106 to allow the drilling fluid 'F' to flow the cuttings 'C' to the surface 113 of the wellbore 106. Specifically, in a non-vertical wellbore, the blades 206 or grooves can move the drilling cuttings 'C' from below the rotor 200 in the annulus 111 to another location (e.g., above the rotor 200) in the annulus 111 to free the cuttings 'C' from the weight of the drill string 102 and allow the cuttings 'C' to move with the drilling fluid 'F' to the surface of the wellbore 106.

Figure 4:
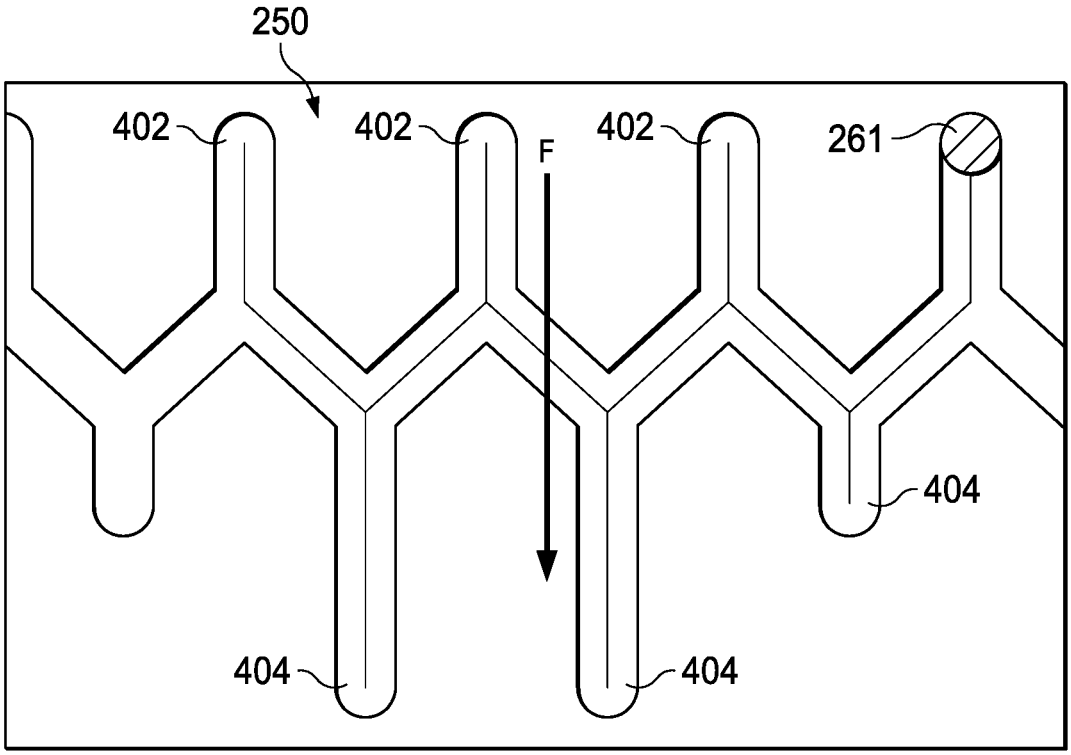
FIG. 4 is a front schematic view of a portion of a cam system of the drilling sub in FIG. 2.

Referring also to FIG. 4, the zigzag-shaped groove 250 is a continuous-cycle groove that extends along the circumference of the bore 205 (or a sleeve attached to the bore 205) that guides the pin 261 or guide of the cam shaft 213. The groove 250 has upper sections 402 in which the pin 261 temporarily resides when the cam shaft is far from the valve, and lower sections 404 in which the pin 261 temporarily resides when the cam shaft is closer to the valve. Referring back to FIG. 3, the choke valve 220 creates back pressure that forces more fluid to go through progressive cavity pump. More fluid going to the progressive cavity pump will increase the RPM of the rotor based on the design (e.g., number of loops) of the progressive cavity. In some implementations, the drilling sub 102 can have one or more sensors 272 to help control the rotational speed of the rotor 200. The sensors 272 can be part of the cam assembly 235.

The sensors 272 can reside downstream of the valve 225 and upstream of the second fluid port 242. The sensors 272 can be communicatively coupled to the processor 110 (see FIG. 1) to transmit, to the processor 110, the information (e.g., the fluid pressure) of the fluid 'F' to determine the flow rate of the fluid 'F'. As described above, instead of using the sensors 272 of the drilling sub 102, the processor can determine the flow rate and other properties of the fluid based on the rig sensors.

In some implementations, the processor can use the determined flow rate to determine a position of the valve 225. For example, based on the flow rate of the fluid 'F' (and based on a predetermined relationship between the spring stiffness and the flow rate), the processor can determine if the fluid is moving the needle 228 toward the seat 229 or if the spring 236 is moving the needle 228 away from the seat 229. The processor can also determine the flow rate of the fluid 'F' required to move the needle 228 toward the seat 229. For example, the processor can determine a flow rate required to move the cam assembly (e.g., the cam shaft 213) toward the needle to push the needle toward the seat, or a flow rate required to allow the spring 236 to move the needle 228. Closing the valve 228 diverts the fluid 'F' toward the progressive cavity 210, which rotates the rotor 200. Thus, the processor determines a flow rate to either 1) decrease an amount of fluid flowing past the valve to increase a rotational speed (e.g., the revolutions per minute) of the rotor or 2) increase an amount of fluid flowing past the valve to decrease a rotational speed of the rotor. The processor can also determine a required flow rate to begin rotation of the rotor 200 and a required flow rate to stop the rotor 200 from rotating.

The processor 110 can also determine a rotational speed of the rotor 200 based on drilling information received from the drill string 101 (e.g., information detected by the BHA 104 or a measuring while drilling system). The drilling information may include one or more of an angle of the wellbore, drag experienced by the drill string, or torque experienced by the drill string. The processor can determine what flow rate is required to set the rotor 200 at the required speed to reduce the friction experienced by the drill string 101.

Additionally, the processor can determine a rotational speed of the rotor 200 required to properly clean the wellbore 106. There can be a positive relation between rotor RPM and wellbore cleaning, in which the higher the rotor RPM, the more efficient the hole cleaning. It is theorized that, in a non-vertical wellbore, because the slip movement and velocity of the cutting 'C' is generally perpendicular with respect to the fluid in the annulus (due to gravity), the drilling fluid 'F' has more difficulty (compared to vertical wellbores) flowing the cuttings 'C' to the surface of the wellbore. This can cause the cuttings 'C' to settle in the low side of the wellbore and get accumulated, creating bigger problems such as stuck pipe. Having the rotor at a high speed can agitate the cuttings 'C' from the low side to the main stream of the flow to be carried out to the vertical section of the wellbore, where the cuttings 'C' can be flown to the surface of the wellbore.

Figure 5:
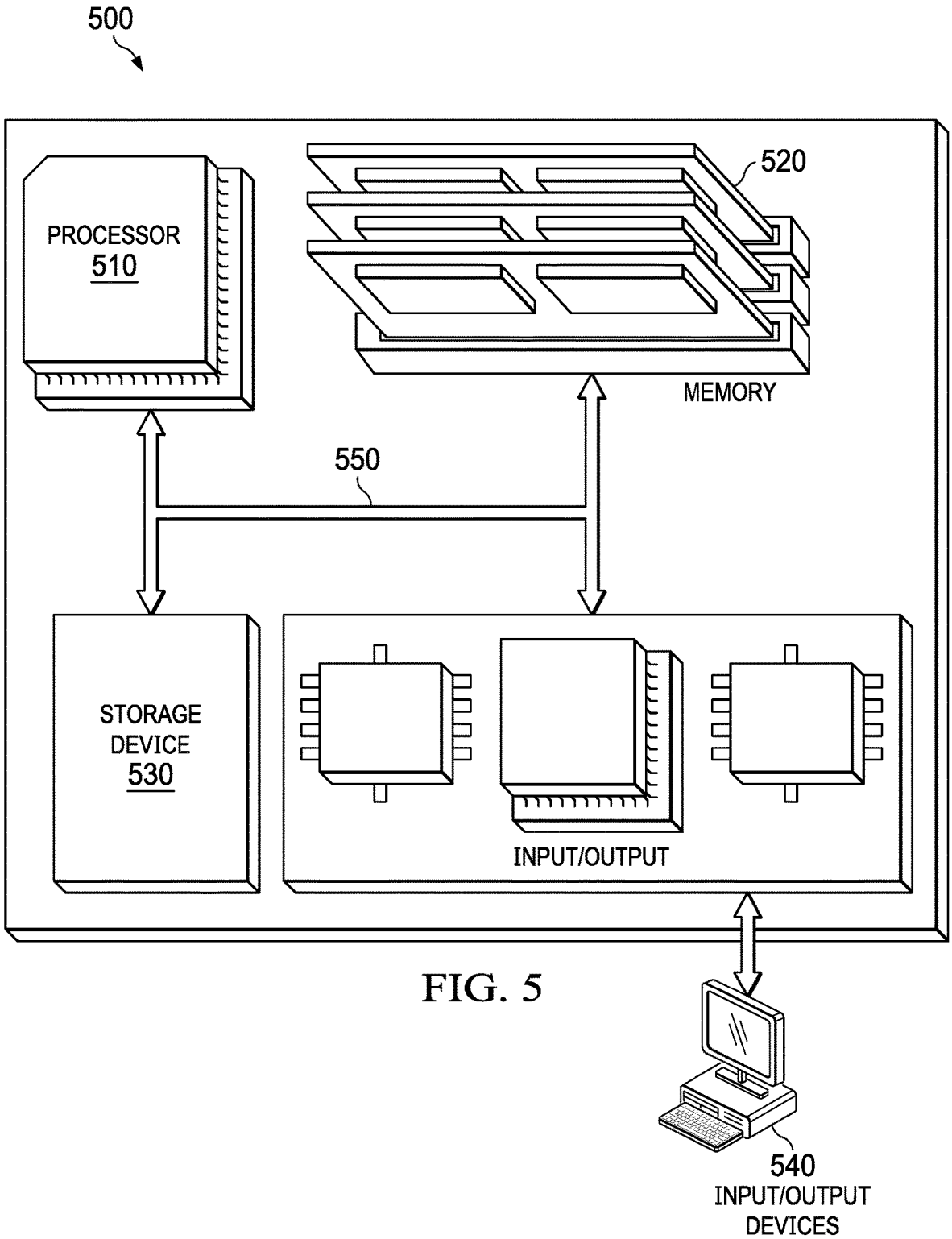
FIG. 5 is a schematic illustration of an example control system of the wellbore assembly.

FIG. 5 is a schematic illustration of an example control system or controller for a flow meter according to the present disclosure. For example, the controller 500 may include or be part of the controller 116 shown in FIG. 1 or may include or be part of the controller 116 and processor 110 shown in FIG. 1. The controller 500 is intended to include various forms of digital computers, such as printed circuit boards (PCB), processors, digital circuitry, or otherwise. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 500 includes a processor 510, a memory 520, a storage device 530, and an input/output device 540. Each of the components 510, 520, 530, and 540 are interconnected using a system bus 550. The processor 510 is capable of processing instructions for execution within the controller 500. The processor may be designed using any of a number of architectures. For example, the processor 510 may be a CISC (Complex Instruction Set Computers) processor, a RISC (Reduced Instruction Set Computer) processor, or a MISC (Minimal Instruction Set Computer) processor.

In one implementation, the processor 510 is a single-threaded processor. In another implementation, the processor 510 is a multi-threaded processor. The processor 510 is capable of processing instructions stored in the memory 520 or on the storage device 530 to display graphical information for a user interface on the input/output device 540.

The memory 520 stores information within the controller 500. In one implementation, the memory 520 is a computer-readable medium. In one implementation, the memory 520 is a volatile memory unit. In another implementation, the memory 520 is a non-volatile memory unit.

The storage device 530 is capable of providing mass storage for the controller 500. In one implementation, the storage device 530 is a computer-readable medium. In various different implementations, the storage device 530 may be a floppy disk device, a hard disk device, an optical disk device, or a tape device.

The input/output device 540 provides input/output operations for the controller 500. In one implementation, the input/output device 540 includes a keyboard and/or pointing device. In another implementation, the input/output device 540 includes a display unit for displaying graphical user interfaces.

Figure 6:
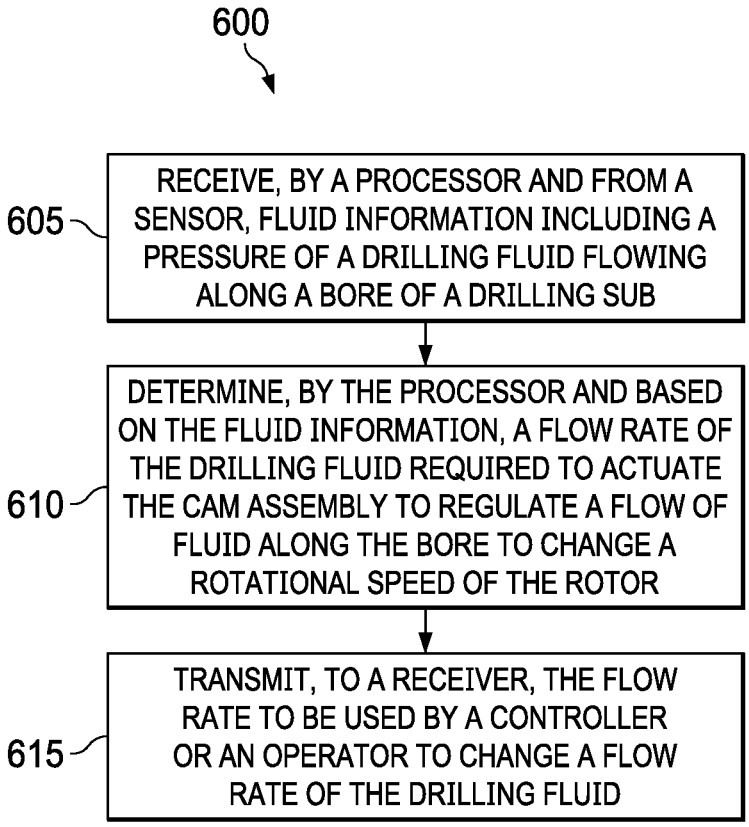
FIG. 6 is a flow chart of an example method of controlling a drilling sub to reduce friction in a drill string or clean a wellbore or both.

FIG. 6 is a flow chart of an example method 600 of controlling a drilling sub. The method includes receiving, by a processor and from a sensor, fluid information including a pressure of a drilling fluid flowing along a bore of a drilling sub (605). The drilling sub includes a stator fluidically coupled to and rotationally fixed to a drill string. The stator has a bore configured to receive and flow the drilling fluid from the pipe. The stator has a helically undulated outer surface. The drilling sub also includes a rotor rotationally coupled to and residing outside the stator. The rotor has a helically undulated internal surface to form, with the helically undulated outer surface of the stator, a progressive cavity configured to receive fluid from the bore of the stator to allow the fluid to rotate the rotor as the fluid flows along the progressive cavity. The drill string also includes a valve coupled to the bore and a cam assembly coupled to and configured to move the valve to regulate a flow of drilling fluid along the bore. The method also includes determining, by the processor and based on the fluid information, a flow rate of the drilling fluid required to actuate the cam assembly to regulate a flow of fluid along the bore to change a rotational speed of the rotor (610). The method also includes transmitting, to a receiver, the flow rate to be used by a controller or an operator to change a flow rate of the drilling fluid (615).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A drilling assembly comprising:

a drill string configured to be disposed within a wellbore, the drill string configured to flow drilling fluid; and a sub fluidically coupled to the drill string, the sub comprising:

a mandrel fixed to the drill string and defining an external helically undulated surface and a bore configured to flow the drilling fluid received from the drill string, a sleeve rotationally coupled to and disposed outside the mandrel, the sleeve comprising an internal helically undulated surface corresponding with the external helically undulated surface of the mandrel to form, with the mandrel, a progressive cavity configured to receive fluid from the bore of the mandrel to rotate the sleeve as the drilling fluid flows along the cavity, and a valve coupled to the bore of the mandrel, the valve controllable to selectively open and close a fluid port to selectively regulate a flow of the drilling fluid along the bore to direct fluid toward or away from the progressive cavity and control a rotational speed of the sleeve.

2. The drilling assembly of claim 1, wherein the bore of the mandrel comprises a second fluid port spaced from the fluid port and with the valve disposed between the two fluid ports, the sleeve comprising a fluid inlet in fluid communication with and configured to receive the drilling fluid from one of the two fluid ports and comprising a fluid outlet in fluid communication with and configured to flow the drilling fluid to the other of the two fluid ports.

3. The drilling assembly of claim 2, wherein the sub further comprises a cam assembly residing inside the bore and operationally coupled to the valve, the cam assembly configured to convert a linear force into rotational motion to move the valve to regulate the flow.

4. The drilling assembly of claim 3, wherein the valve comprises a choke valve comprising a needle and a seat and residing between the two fluid ports, the needle defining a tapered end converging in a flow direction of the drilling fluid and the seat configured to receive the tapered end of the needle to close a fluid pathway of the sub extending along the bore.

5. The drilling assembly of claim 4, wherein the cam assembly comprises a rotatable cam shaft residing upstream of the needle and comprising a curved end and a pin extending from an exterior surface of the cam shaft, the cam assembly comprising a spring configured to urge the cam shaft away from the needle, the cam shaft configured to move toward the needle under fluidic pressure of the drilling fluid, the cam assembly comprising a continuous zigzag-shaped groove configured to receive the pin and extending along a circumference of the bore or a cam sleeve of the cam assembly attached to the bore, the pin configured to follow the groove to rotate the cam shaft as the spring or fluidic pressure moves the cam shaft in a direction parallel to the flow direction of the fluid, the needle rotationally fixed with respect to the cam shaft and comprising a curved end opposite the tapered end and facing the curved end of the shaft, the curved end of the needle corresponding with the curved end of the cam shaft such that rotation of the cam shaft at least intermittently moves the needle in a direction parallel to the flow direction of the fluid toward the seat of the valve.

6. The drilling assembly of claim 5, wherein the cam shaft is configured to move toward the needle with the drilling fluid at a first flow rate, and the spring is configured to move the cam shaft away from the needle with the drilling fluid at a second flow rate less than the first flow rate.

7. The drilling assembly of claim 5, further comprising a processor communicatively coupled to one or more sensors coupled to the drill string and configured to detect and transmit, to the processor, a pressure of the drilling fluid in the drill string, the processor configured to determine, based on the detected pressure, a flow rate of the drilling fluid required to move the cam shaft along the fluid direction of the drilling fluid to at least one of: begin rotation of the sleeve, increase a revolutions per minute of the sleeve, or stop the sleeve from rotating.

8. The drilling assembly of claim 5, wherein the choke valve comprises a spring configured to urge the needle away from the seat, the spring configured to at least intermittently move the needle away from the seat as the cam shaft rotates along the groove.

9. The drilling assembly of claim 1, wherein the sleeve or the mandrel comprises a locking assembly disposed between the sleeve and the mandrel and configured to constrain the sleeve to rotation along the rotational direction of the drill string, the sleeve configured to rotate at higher revolutions per minute than the drill string.

10. The drilling assembly of claim 1, wherein the sleeve comprises a reaming outer surface comprising external blades or grooves configured to ream and clean the wellbore during rotation of the sleeve.

11. The drilling assembly of claim 10, wherein the blades or grooves span at least 70% of a length of the sleeve.

12. The drilling assembly of claim 10, wherein the blades or grooves comprise router flutes arranged to agitate, during rotation of the sleeve, drilling cuttings in the wellbore to allow the drilling cuttings to flow, with the drilling fluid, to a surface of the wellbore.

13. An apparatus comprising:

a stator fluidically coupled to and rotationally fixed to a pipe, the stator comprising a bore configured to receive and flow fluid from the pipe, the stator comprising a helically undulated outer surface and two fluid ports configured to fluidically couple the helically undulated outer surface with the bore;

a rotor rotationally coupled to and residing outside the stator, the rotor comprising a helically undulated internal surface to form, with the helically undulated outer surface of the stator, a progressive cavity extending from one of the two fluid ports to the other of the two fluid ports and configured to receive fluid from the bore of the stator to allow the fluid to rotate the rotor as the fluid flows along the progressive cavity; and a valve coupled to the bore between the two ports and controllable to selectively open and close one of the two fluid ports to selectively regulate a flow of fluid flowing in the progressive cavity and control a rotational speed of the rotor.

14. The apparatus of claim 13, wherein the pipe comprises a drill pipe configured to be disposed within a wellbore, the rotor comprising an outer surface defining external blades or grooves configured to contact a wall of the wellbore to agitate the drill string during rotation of the rotor, the outer surface configured to loosen, during rotation of the rotor, cuttings in the wellbore to allow the drilling cuttings to flow, with the fluid, to a surface of the wellbore.

15. The apparatus of claim 13, wherein the flow regulation assembly comprises a cam assembly and a choke valve coupled to the cam assembly and comprising a needle and a seat, the cam assembly comprising a spring and a cam shaft configured to rotate under a fluidic pressure of the fluid applied at a first end of the cam assembly and configured to rotate under a normal force applied by the spring to a second end of the cam assembly opposite the first end, the cam shaft defining a curved end facing the needle and configured to convert rotational motion into linear motion to intermittently move, during rotation of the cam shaft, the needle toward the seat by contactingly pushing the needle during rotation of the cam shaft.

16. The apparatus of claim 15, further comprising a processor communicatively coupled to one or more sensors coupled to the drill string and configured to detect and transmit, to the processor, a pressure of the drilling fluid in the drill string, the processor configured to determine, based on the detected pressure, a flow rate of the drilling fluid required to move the cam shaft along the fluid direction of the drilling fluid to at least one of: begin rotation of the sleeve, increase a revolutions per minute of the sleeve, or stop the sleeve from rotating.

17. A method comprising:

receiving, by a processor and from a sensor, fluid information including a pressure of a drilling fluid flowing along a bore of a drilling sub, the drilling sub comprising:

a stator fluidically coupled to and rotationally fixed to a drill string, the stator comprising the bore configured to receive and flow the drilling fluid from the drill string, the stator comprising a helically undulated outer surface, a rotor rotationally coupled to and residing outside the stator, the rotor comprising a helically undulated internal surface to form, with the helically undulated outer surface of the stator, a progressive cavity configured to receive the drilling fluid from the bore of the stator to allow the drilling fluid to rotate the rotor as the fluid flows along the progressive cavity, a valve coupled to the bore, and a cam assembly coupled to and configured to move the valve to regulate a flow of drilling fluid along the bore;

determining, by the processor and based on the fluid information, a flow rate of the drilling fluid required to actuate the cam assembly to regulate a flow of fluid along the bore to change a rotational speed of the rotor; and transmitting, to a receiver, the flow rate to be used by a controller or an operator to change a flow rate of the drilling fluid.

18. The method of claim 17, wherein the sensor is coupled to the drill string at a surface of the wellbore and configured to detect a fluidic pressure of the drilling fluid, and determining the flow rate comprises determining a flow rate required to move the cam assembly to 1) decrease an amount of fluid flowing past the valve to increase a rotational speed of the rotor or 2) increase an amount of fluid flowing past the valve to decrease a rotational speed of the rotor.

19. The method of claim 17, further comprising determining, based on drilling information received from the drill string, the flow rate, the information including at least one of an angle of the wellbore, drag of the drill string, or torque of the drill string.

20. The method of claim 17, wherein the cam assembly comprises a spring configured to urge a portion of the cam assembly in a direction opposite the flow direction of the fluid with the drilling fluid below a predetermined flow rate, and determining the flow rate comprises determining a flow rate above the predetermined flow rate to move the portion of the cam assembly toward the valve to rotate the portion of the cam assembly, and determining a flow rate below the predetermined flow rate to allow the spring to move the portion of the cam assembly away from the valve to rotate the portion of the cam assembly.

* * * * *